US009243869B1

(12) United States Patent
Horvath et al.

(10) Patent No.: US 9,243,869 B1
(45) Date of Patent: Jan. 26, 2016

(54) WEAPON POSTURING SYSTEM AND METHODS OF USE

(75) Inventors: Charles L. Horvath, Plano, TX (US); Preston Powell, Arlington, TX (US)

(73) Assignee: Raytheon Company, Waltham, MA (US)

( * ) Notice: Subject to any disclaimer, the term of this patent is extended or adjusted under 35 U.S.C. 154(b) by 164 days.

(21) Appl. No.: 13/561,415

(22) Filed: Jul. 30, 2012

Related U.S. Application Data

(60) Provisional application No. 61/521,422, filed on Aug. 9, 2011.

(51) Int. Cl.
*F41G 5/06* (2006.01)
*F41G 3/16* (2006.01)

(52) U.S. Cl.
CPC ..... *F41G 3/165* (2013.01)

(58) Field of Classification Search
CPC ..... F41G 3/165; F41G 3/06; F41G 3/16; F41G 5/06; F41A 27/28; F41A 23/24; F41A 23/56
USPC ..... 89/41.05, 41.07, 204–206
See application file for complete search history.

(56) References Cited

U.S. PATENT DOCUMENTS

| | | | | |
|---|---|---|---|---|
| 4,528,891 | A * | 7/1985 | Brunello et al. | 89/41.21 |
| 4,574,685 | A * | 3/1986 | Sanborn et al. | 89/37.14 |
| 6,499,382 | B1 * | 12/2002 | Lougheed et al. | 89/41.05 |
| 7,021,188 | B1 | 4/2006 | Berkovich et al. | |
| 7,509,904 | B2 * | 3/2009 | Plumier | 89/41.05 |
| 2007/0261544 | A1 | 11/2007 | Philippe | |
| 2008/0148931 | A1 * | 6/2008 | Svensson et al. | 89/41.05 |
| 2010/0275768 | A1 * | 11/2010 | Quinn | 89/41.05 |

FOREIGN PATENT DOCUMENTS

| | | | |
|---|---|---|---|
| EP | 1 923 657 | A1 | 5/2008 |
| WO | WO 2004/048879 | A2 | 6/2004 |
| WO | WO 2004/048879 | A3 | 6/2004 |

OTHER PUBLICATIONS

PCT Search Report and Written Opinion of the ISA; dated Apr. 17, 2013; for PCT Pat. App. No. PCT/US2012/048797; 14 pages.
PCT International Preliminary Report on Patentability and Written Opinion of the ISA dated Feb. 20, 2014; for PCT Pat. App. No. PCT/US2012/048797; 8 pages.
European Reponse dated Apr. 22, 2014; for European Pat. App. No. 12823182.6; 11 pages.
European Office Action dated Mar. 16, 2015; for European Pat. App. No. 12 823 182.6; 6 pages.
European Response filed Jun. 25, 2015; to Office Action dated Mar. 16, 2015; for European Pat. App. No. 12823182.6; 10 pages.
European Patent Office Intention to Grant with Annex and Patent to Issue Showing Changes dated Oct. 23, 2015; For European Pat. App. 12 823 182.6-1655; 27 pages.

* cited by examiner

*Primary Examiner* — Benjamin P Lee
(74) *Attorney, Agent, or Firm* — Daly, Crowley, Mofford & Durkee, LLP

(57) ABSTRACT

An assembly for changing the posture of a weapon coupled to a sensor system comprises a weapon mount configured to support a weapon. The assembly further comprises a movement mechanism coupled between the weapon mount and the sensor system. The movement mechanism is movable between a first configuration in which a boresight or barrel of the weapon is aligned with a first axis of a line of sight of the sensor system and a second configuration in which the barrel of the weapon is disposed along a second axis rotated with respect to the first axis such that the weapon is no longer pointed in the same direction as the sensor.

10 Claims, 5 Drawing Sheets

WEAPON POSTURING SYSTEM AND METHODS OF USE

CROSS-REFERENCE TO RELATED APPLICATIONS

This application CLAIMS THE BENEFIT OF to U.S. Provisional Application Ser. No. 61/521,422, filed on Aug. 9, 2011, which is incorporated herein by reference in its entirety.

BACKGROUND

Infantry fighting vehicles (IFVs), such as the vehicles in the Bradley Infantry Fighting Vehicle family, are frequently called into service in hostile areas where the vehicles may be required to serve multiple purposes including the suppression of enemy troops and the support of peace-keeping and/or law-enforcement efforts. An IFV may comprise a sensor suite that captures images of the area around the IFV, allowing one or more members of the IFV's crew to view the surroundings from inside the relative safety of the armored IFV. Often a sensor suite is coupled to a weapon, with the weapons boresight or barrel aligned with a set of crosshairs or other type of reticle produced by the sensor suite. This allows the crew to respond to the surroundings from inside the relative safety of the armored IFV. When the IFV is deployed in a primarily non-combat mission, such as peace keeping, surveillance, civil unrest, or law enforcement, the weapon coupled to the sensor suite may be viewed as a hostile threat by the civilians in the region patrolled by the IFV. Accordingly, systems and methods are needed to allow the weapon and sensor suite to adjust the projected threat level to be appropriate to the situation or hostility levels of its surroundings.

SUMMARY

In contrast to the above-described conventional approaches, embodiments of the present concepts, systems, and techniques are directed to an apparatus and method of use thereof for changing the posture of a weapon coupled to a sensor system, the assembly comprising: a weapon mount configured to support the weapon and a movement mechanism coupled between the weapon mount and the sensor system, wherein the movement mechanism is movable between a first configuration in which a boresight or barrel of the weapon is aligned with a first axis of a line of sight of the sensor system and a second configuration in which the boresight or barrel of the weapon is disposed along a second axis rotated with respect to the first axis.

In some embodiments of the assembly, the assembly may comprise one or more of the following features: an electronic control system in communication with the movement mechanism, wherein the movement mechanism is responsive to a command from the electronic control system and/or a trigger mechanism configured to engage a trigger of the weapon. Furthermore, the movement mechanism may comprise a motor assembly responsive to a motor control system. When employed, a motor assembly may comprise a drive shaft directly coupled to the weapon mount; at least one gear coupled between the motor assembly and the weapon mount; and/or a biasing device. In some embodiments, the movement mechanism, the sensor system, and the weapon may be pivotable on a common support.

Another embodiment of the present concepts, systems, and techniques is directed to a method for changing the posture of a weapon coupled to a sensor system, the method comprising: aligning a boresight of the weapon with a line of sight of the sensor system; and remotely operating a movement mechanism coupled between the sensor system and the weapon to pivot the boresight of the weapon relative to the line of sight of the sensor system.

In some embodiments of the method, the movement mechanism may comprise a trigger mechanism and the method may further comprise remotely operating the trigger mechanism to engage a trigger of the weapon. Furthermore, the movement mechanism may comprise a motor with a drive shaft, at least one gear, and/or a biasing device. In some embodiments, the boresight of the weapon may be pivoted about an axis parallel to the drive shaft. In some embodiments, the movement mechanism, the sensor system, and the weapon may be pivotable on a common support.

A further embodiment of the present concepts, systems, and techniques is directed to an assembly for changing the posture of a weapon, the assembly comprising: a weapon mount configured to support the weapon; a sensor system comprising: at least one sensor, a sighting aperture aligned along a line of sight and a mounting platform; and a movement mechanism coupled between the weapon mount and the mounting platform, wherein the movement mechanism is movable between a first configuration in which a boresight or barrel of the weapon is aligned with a first axis of the line of sight of the sensor suite and a second configuration in which the boresight or barrel of the weapon is disposed along a second axis rotated relative to the first axis.

In some embodiments of the assembly, the assembly may comprise one or more of the following features: the sensor may comprise and infrared sensor and/or a thermal sensor; and/or the movement mechanism may comprise a motor.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The following disclosure provides many different embodiments, or examples, for implementing different features of the invention. Specific examples of components and arrangements are described below to simplify the present disclosure. These are, of course, merely examples and are not intended to be limiting.

Figure 1:
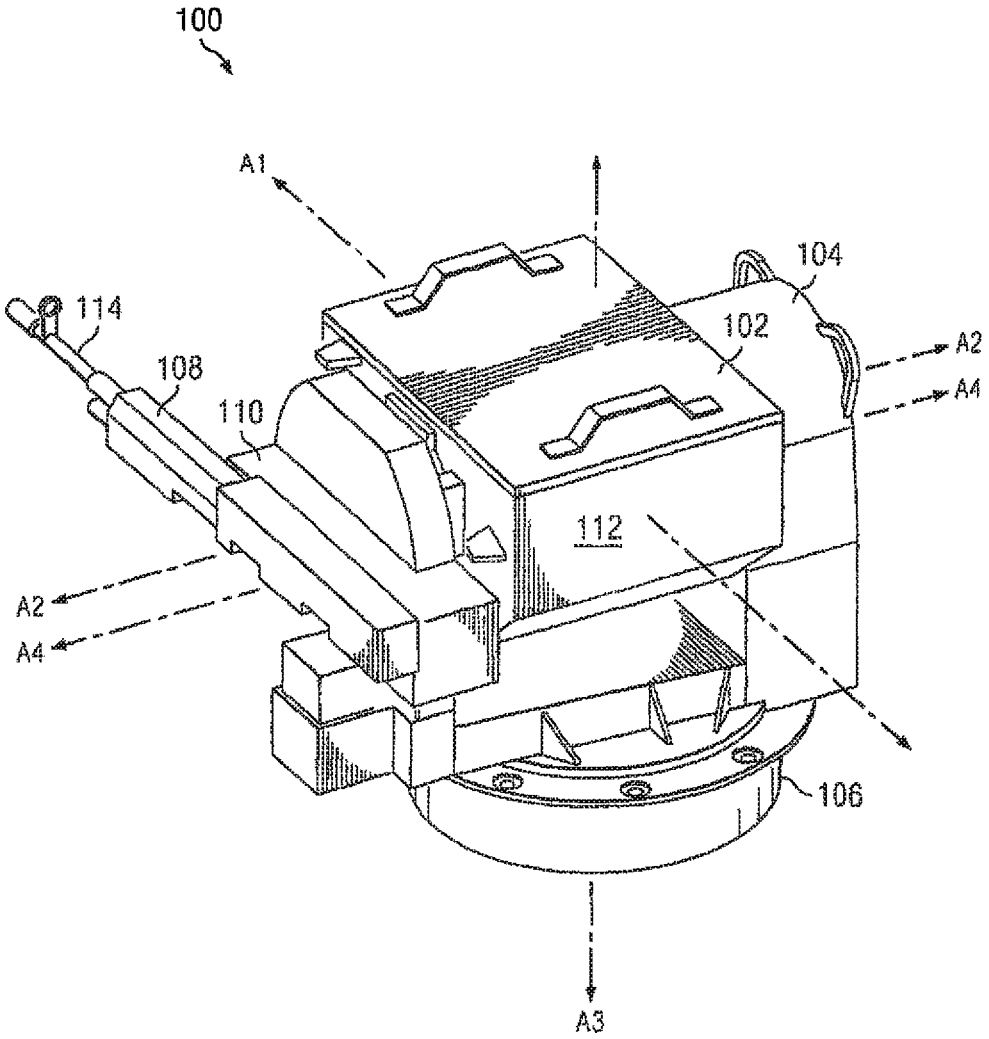
FIG. 1 is a perspective view of a sensor system coupled to a weapon in a firing posture, according to one embodiment of the disclosure.

Referring first to FIG. 1, a weaponized sensor suite 100 comprises a sensor system 102 movably mounted to a fixture or mount 104, which is supported by a common support assembly 106. A weapon 108 is mounted to the sensor suite 100 via a movement mechanism 110. The weaponized sensor suite 100 may be mounted to an Infantry Fighting Vehicle (IFV) or any other type of land-based vehicle, aircraft, or watercraft.

The sensor system 102 may comprise, for example, a Commander's Independent Viewer (CIV) manufactured by Raytheon Company of Waltham, Mass. for use on the M2A3 or M2A3 Bradley IFV. The sensor system 102 may comprise, for example, an infrared (IR) imaging system, such as a forward-looking IR (FLIR) imaging system, which comprises an IR sensor. An IR imaging system may generate a video output that can be used to assist an operator of the weaponized sensor suite 100 view the surroundings of the IFV at night or in adverse conditions. The sensor system 102 may also comprise, for example, a daylight television imaging system. Other types of electro-optical, laser, radar, thermal, or other energy based imaging systems may be incorporated into the sensor system 102. Images from any and all of the imaging systems may be viewed on a display system within the IFV. The sensor system 102 may also comprise a housing 112 that contains optical and electronic equipment for the imaging systems. A datum axis (line of sight) for the imaging systems of the sensor system extends generally along an axis A1. A sighting aperture (not visible in FIG. 1, but see FIG. 5) in the housing 112 may be aligned about the datum axis A1.

Figure 3:
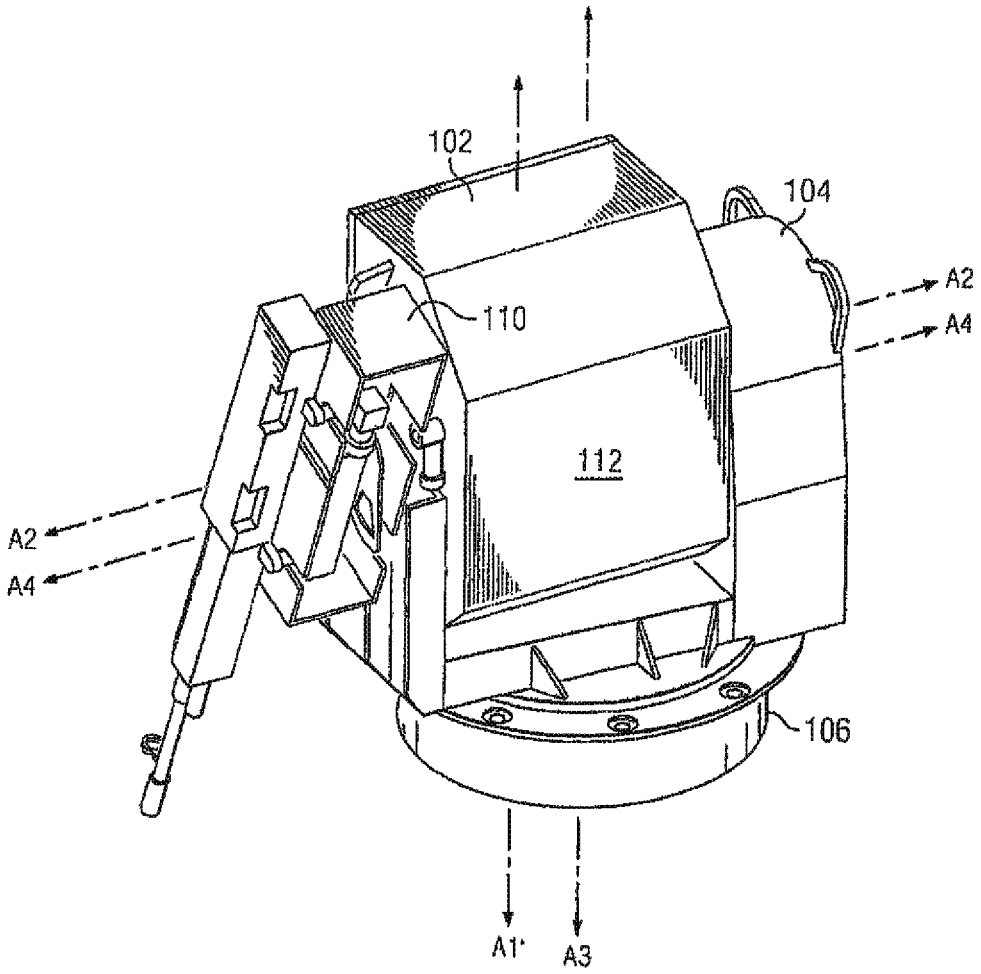
FIG. 3 is a perspective view of a sensor system coupled to a weapon in a stowed posture, according to one embodiment of the disclosure.

The fixture or mount 104 may comprise a pivot mechanism (not shown) that permits the housing 112 to pivot about an axis A2. When the sensor system 102 is not in use, for example, the housing 112 may pivot approximately −90° about the axis A2 into a dormant position (See. FIG. 3). The fixture 104 and thus the sensor housing 112 are mounted to the support assembly 106 which may comprise a gimbal that is rotatable about an axis A3.

The weapon 108 may be a machine gun, but other types armaments that fire projectiles including shells, shot, missiles, rockets, grenades, rubber bullets, or paint bullets may be used. Alternatively, the weapon 108 may be an energy-based weapon such as a laser or thermal weapon. In the embodiment of FIG. 1, the weapon 108 comprises a barrel 114. In FIG. 1, the weapon 108 is disposed in a firing posture in which the barrel 114 of the weapon 108 is roughly aligned parallel with the line of sight of sensor system 102, except for special cases including but not limited to super (i.e., greater than horizontal) elevation. Standard alignment techniques are used to align the weapon to the sight including firing a burst and adjusting or using a laser inserted into the gun barrel.

Although a weapon having a barrel is described, those skilled in the art will realize that weapons other than those having a barrel in the conventional sense may be used, such as but not limited to energy weapons, can be used. Furthermore, although the term "barrel" is used to denote the "shooting" portion of the weapon, the term boresight may also be used interchangeable to describe weapons that lack a conventional barrel per se. Accordingly, the concepts, systems, and techniques described herein are not limited to any particular type of weapon.

Common support assembly 106 may be a gimbal or rotary (pivoting) fixture of the type commonly employed on mobile vehicles and the like for sensors and/or weapons systems, without limitation.

Figure 2:
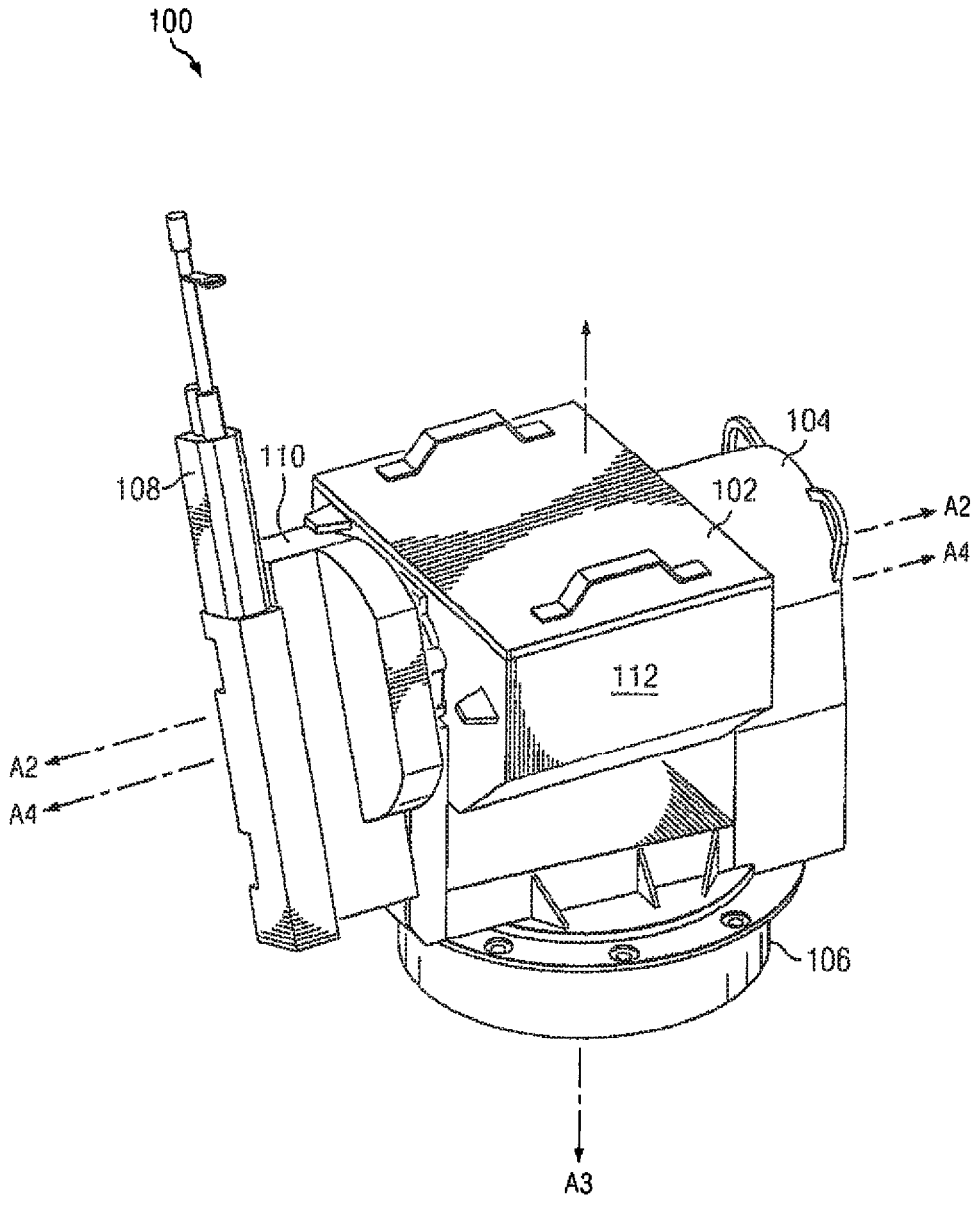
FIG. 2 is a perspective view of a sensor system coupled to a weapon in a raised posture, according to one embodiment of the disclosure.

Referring now to FIG. 2, the weapon 108 may be pivoted relative to the sensor housing 112 about an axis A4 into a raised posture, thus decoupling the weapon from alignment with the sensor system 102 line of sight and datum axis A1 (shown in FIG. 1). The raised posture shown in FIG. 2 can position the barrel 114 of the weapon 108 at approximately 70° from the firing posture shown in FIG. 1. The raised posture may serve multiple purposes. For example, in the raised position, the weapon 108 may lob a projectile rather than direct firing. Alternatively, positioning the weapon 108 in the raised position may reduce the hostile threat perceived by civilians when the vehicle is deployed on peacekeeping, surveillance, civil unrest, or law enforcement missions. Further, the raised posture may serve as a safety mechanism in that an accidentally fired weapon would not be aimed directly at civilians or property surrounding the vehicle. Although FIG. 2 depicts the weapon rotated to approximately 70° from the firing posture of FIG. 1, the weapon may be rotated greater than or less than 70° in the raised posture, for example in a range up to about 90 degrees.

Referring now to FIG. 3, the weapon 108 may be pivoted relative to the sensor housing 112 about the axis A4 into a stowed posture. (The weapon 108 may be rotated independently of the sensor housing 112.) The stowed posture shown in FIG. 3 may position the barrel 114 of the weapon 108 rotated approximately −70° from the firing posture shown in FIG. 1. Other rotation angles are possible, without limitation, up to about 90 degrees. The stowed position may be used when the weapon 108 and/or the sensor system 102 is not in service. Additionally, the stowed posture may serve the same safety and threat mitigation purposes described above for the raised posture. FIG. 3 also depicts the housing 112 rotated approximate −90° into a dormant position wherein the optical line of sight for the imaging systems of the sensor system 102 extends generally along an axis A1'. This dormant position may protect the optical components of the sensor system 102 when the system is not in use.

Although the sensor system 102 is shown in a dormant position with the weapon 108 in a stowed posture, alternatively, the weapon 108 may be in the stowed posture when the sensor system 102 is in an active position as shown in FIG. 1. Further, the weapon may be at any angle relative to the axis A1' that prevents the weapon from interfering with the vehicle.

Figure 4:
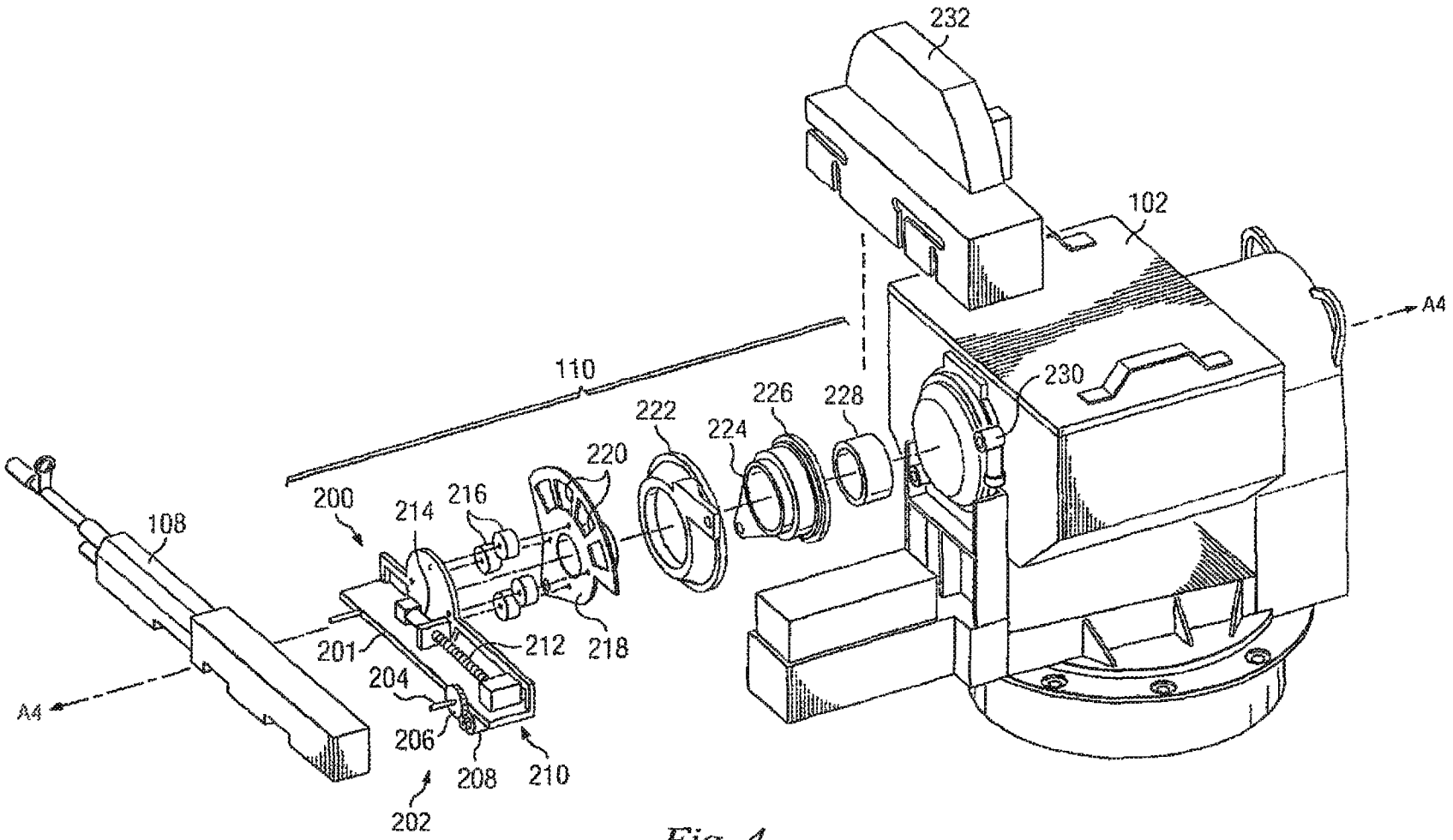
FIG. 4 is an exploded view of the embodiment of FIG. 1.

FIG. 4 provides an exploded view of the weaponized sensor suite 100, particularly the movement mechanism 110. The movement mechanism 110 functions to rotate the weapon 108 about the axis A4 relative to the sensor housing 112. In detail, the movement mechanism 110 may comprise a weapon mount 200 including a platform 201 sized and shaped to support the weapon 108. The movement mechanism 110 further comprises a trigger mechanism 202, which comprises a pin 204, a gear 206, and a motor 208. The pin 204 may be arranged to engage the trigger of the weapon 108 to fire the weapon in response to an electronic control signal sent to the motor 208. The movement mechanism 110 may also comprise a weapon charger 210 to engage and control the charging handle of the weapon 108. (The charging handle is sometimes referred to as a cocking lever or the like; the nomenclature depends on the weapon selected.) The weapon charger 210 may comprise a linear actuator 212, such as a ball screw, and a motor 214 to drive the linear actuator, or any other means conventionally known and used for such purposes, without limitation. The trigger mechanism 202 and the weapon charger 210 may be operated remotely, such as by a remote user inside the IFV using electronic control devices and systems commonly employed in the relevant arts, without limitation.

The movement mechanism 110 may further comprise isolators 216, which serve to isolate the sensor housing 112 from the shock and vibration of the firing weapon. Although four isolators 216 are shown in the illustrated embodiment, in alternative embodiments fewer, none, or more isolators may be used depending on the sensitivity of the sensor system 102 and the magnitude of the vibration from the weapon 108.

The movement mechanism 110 may further comprise a positioner gear plate 218 that comprises a plurality of radially arranged teeth 220. The plate 218 may be fixedly attached to the weapon mount 200 via the isolators 216. In alternative embodiments, the plate 218 may be directly coupled to the weapon mount 200 without isolators. In still further embodiments, different gear arrangements may also be employed, without limitation. Such gear drive and pivot mechanism arrangements will be readily apparent to those of ordinary skill in the art and may be implemented without undue experimentation by the ordinary practitioner.

The movement mechanism 110 may further comprise a cover 222 and a dynamic seal 224 attached to an inner bearing housing 226. A composite bearing 228 or the like permits rotational motion between the sensor housing 112 and the weapon mount 200. Other sealing and bearing arrangements will be apparent to one of ordinary skill in the art. Accordingly, the present disclosure should not be limited to any single bearing, sealing, or movement mechanism configuration.

A positioner motor 230 may be coupled to the sensor housing 112. In one exemplary embodiment, the positioner motor 230 engages the teeth 220 of the positioner gear plate 218 to rotate the gear plate into positions corresponding to the raised posture, the firing posture, and the stowed posture. Other postures may be defined by the positioner gear plate. In some embodiments, the motor will move the positioner gear plate through discrete settings associated with discrete weapon positions. In alternative embodiments, the motor will move the positioner gear plate through a continuous range of weapon positions.

The positioner motor 230 may be controlled by a motor controller or other electronic control system that may, for example, control the starting and stopping of the motor, the speed of the motor, and the torque of the motor. In one embodiment, the motor controller may comprise an electronic servo controller that uses a closed loop feedback system to adjust the speed and position of the rotating weapon 108 relative to the sensor housing 112. To change the posture of the weapon, the motor controller may be remotely operated by a user in the IFV or automatically in response to electronic signals from, for example, the sensor system 102. The user may remotely operate the motor controller using, for example, a joystick, a dial, a mouse, a trackball, or any other kind of user input device known in the art, without limitation.

The electronic control system may be located within housing 104 (referring to FIG. 1), sensor housing 112, or otherwise disposed anywhere on or in weaponized sensor suite 100, without limitation. Furthermore, the electronic control system may be located, either in whole or in part, within the vehicle, aircraft, or watercraft on which the weaponized sensor suite 100 is mounted, without limitation.

A cover 232 may be sized and shaped to extend over the components of the movement mechanism 110 to protect the movement mechanism from environmental or ballistic debris.

Figure 5:
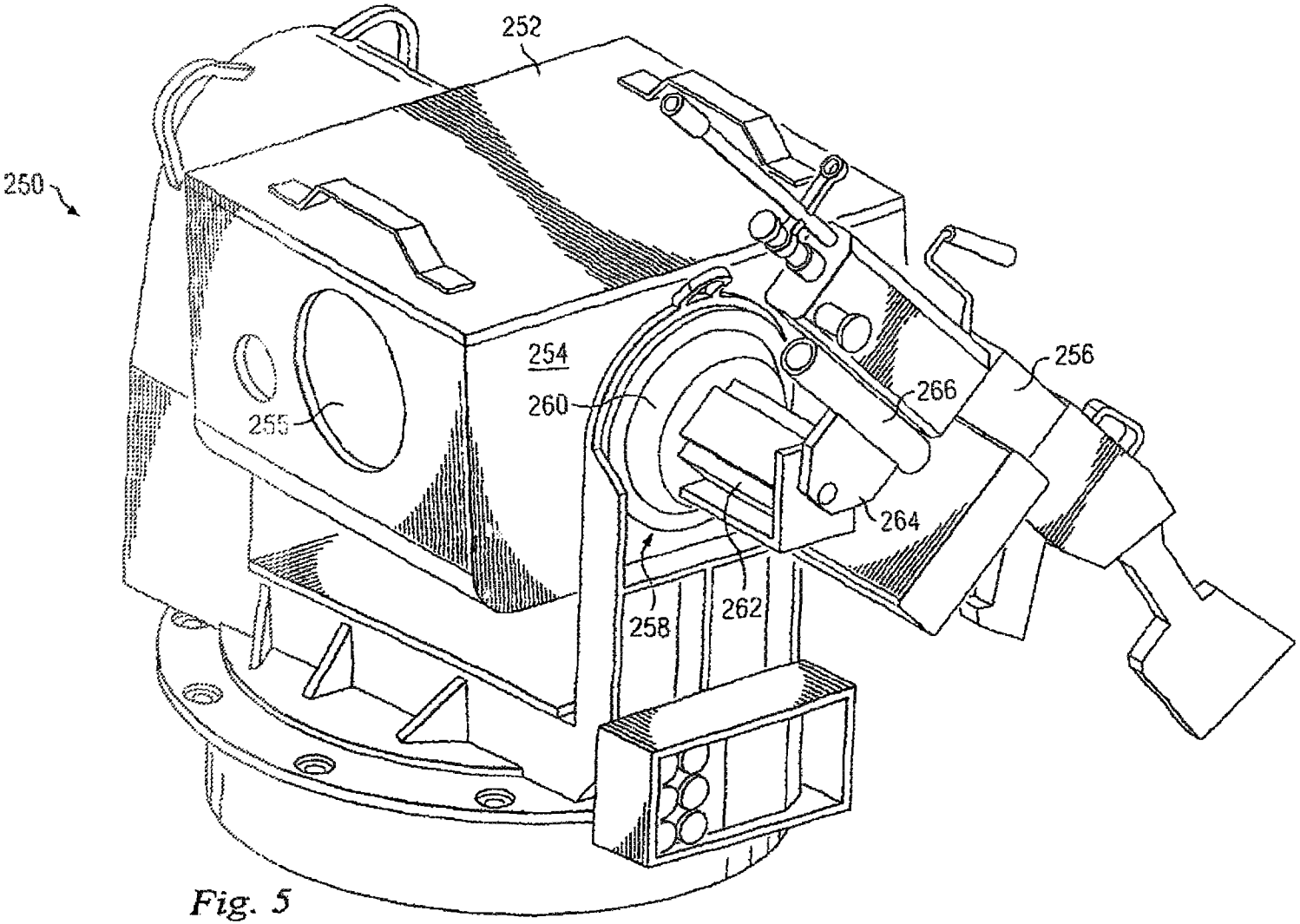
FIG. 5 is a perspective view of a sensor system coupled to a weapon in a raised posture, according to another embodiment of the disclosure.

The motor-based movement mechanism 110 is one example of a movement mechanism that can be used to pivot the weapon 108 relative to the sensor housing 112. FIG. 5 depicts an alternative weaponized sensor suite 250 that comprises a sensor system 252 with a sensor housing 254. A sighting aperture 255 extends through the sensor housing 254. The sensor system 252 may be substantially the same as the sensor system 102. A weapon 256 may be pivotally coupled to the sensor housing 254. The weapon may be substantially the same as the weapon 108. A movement mechanism 258 controls the rotation of the weapon 256 relative to the sensor housing 254. In this embodiment, the movement mechanism 258 comprises a motor (not shown) within a protective cover 260. The motor drives a drive shaft 262 that is rigidly connected to a pivot plate 264. The pivot plate 264 may be directly connected to a weapon mount 266 or connected to the weapon mount via one, none, or more vibration isolators. In this more simplified embodiment, the drive shaft 262 directly rotates the weapon mount without the use of an intermediary gear system.

In other alternative embodiments, the movement mechanism that rotates the weapon relative to the sensor housing may comprise a pin positioning system that uses a retractable pin to allow the weapon to rotate relative to the sensor housing at discrete positions defined by a series of apertures into which the retractable pin may engage. In another alternative embodiment, a movement mechanism may comprise a biasing member, such as a spring (not shown), which biases the weapon into a predetermined posture when the spring is released or compressed. In another alternative embodiment, the movement mechanism may comprise other types of gear assemblies, such as but not limited to a worm gear. In other alternative embodiments, the movement mechanism may move the weapon linearly, for example up/down or front/back, instead of or in addition to the rotational motion. In other alternative embodiments, the movement mechanism may allow the barrel or boresight 114 of the weapon to pivot to an angle oblique to the axis A1.

Referring again to FIGS. 1-3, in one embodiment, a method for changing the posture of the weapon 108 that is coupled to the sensor system 102 comprises first aligning the boresight or barrel of the weapon with the line of sight, along axis A1, of the sensor system. The sensor system 102, the weapon 108, and the movement mechanism 110 are all pivotable in unison about a common gimbal axis A3. When the threat environment surrounding the vehicle to which the sensor system 102 is coupled changes, a user inside the vehicle or otherwise remotely located may determine that the weapon 108 may be moved to a raised or stowed posture. When this determination is made, the user may remotely operate the motor controller causing the movement mechanism 110 to rotate the weapon 108 into the raised or stowed position.

The foregoing outlines features of selected embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure, as defined by the claims that follow.

The method of the present invention may be performed in either hardware, software, or any combination thereof, as those terms are currently known in the art. In particular, the present method may be carried out by any non-transitory software, firmware, and/or microcode operating on or stored in a computer or computers of any type. Additionally, software embodying the present concepts, systems, and techniques may comprise computer instructions in any form (e.g., source code, object code, and/or interpreted code, etc.) stored in any non-transitory computer-readable medium (e.g., ROM, RAM, magnetic media, punched tape or card, compact disc [CD], digital versatile disc [DVD], solid stated disk [SSD]), and/or the like, without limitation). Accordingly, the present invention is not limited to any particular platform, unless specifically stated otherwise in the present disclosure.

The order in which the steps of the present method are performed is purely illustrative in nature. In fact, the steps can be performed in any order or in parallel, unless otherwise indicated by the present disclosure.

While particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

We claim:

1. A method for changing the posture of a weapon coupled to a sensor system, the method comprising:

aligning a boresight of the weapon with a line of sight of the sensor system; and remotely operating a movement mechanism coupled between the sensor system and the weapon to pivot the boresight of the weapon relative to the line of sight of the sensor system to first and second different configurations, wherein, in the first configuration, the weapon mount has a position such that the boresight of the weapon is aligned in accordance with the line of sight of the sensor system, and wherein, the second configuration, the weapon mount is decoupled from alignment with the line of sight of the sensor system and the weapon mount and the sensor system are both rotated to respective stowed postures in which the boresight of the weapon is rotated upward or downward to a non-threatening angle and the line of sight of the sensor system is rotated upward or downward to a protective angle selected to protect optical component of the sensor system.

2. The method of claim 1, further comprising pivoting the weapon, the sensor system, and the movement mechanism on a common support.

3. The method of claim 1, wherein the movement mechanism comprises a motor with a drive shaft.

4. The method of claim 3, wherein the boresight of the weapon is pivoted about an axis parallel to the drive shaft.

5. The method of claim 3, wherein the movement mechanism further comprises at least one gear.

6. The method of claim 1, wherein the movement mechanism comprises a biasing device.

7. The method of claim 1, wherein the movement mechanism comprises a positioning system to allow the weapon mount to rotate relative to the sensor system at discrete relative positions.

8. The method of claim 1, wherein the non-threatening angle is between about seventy degrees and about ninety degrees from horizontal.

9. The method of claim 8, wherein, when in the stowed posture, the line of sight of the sensor system is rotated such that the line of sight of the sensor system points to approximately ninety degrees downward to protect optical component of the sensor system.

10. The method of claim 1, wherein, when in the stowed posture, the line of sight of the sensor system is rotated such that the line of sight of the sensor system points to approximately ninety degrees downward to protect optical component of the sensor system.

* * * * *